US008267169B2

(12) United States Patent
Moen et al.

(10) Patent No.: US 8,267,169 B2
(45) Date of Patent: Sep. 18, 2012

(54) METHODS AND APPARATUS FOR ATTACHING ACCESSORIES TO SAND SCREEN ASSEMBLIES

(75) Inventors: Terje Moen, Sandnes (NO); Arthur H. Dybevik, Sandnes (NO); Michael D. Langlais, Houston, TX (US); Brody Dunn, Bartlesville, OK (US); Tage Thorkildsen, Raege (NO); Kjartan Roaldsnes, Kvernaland (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 220 days.

(21) Appl. No.: 12/403,506

(22) Filed: Mar. 13, 2009

(65) Prior Publication Data

US 2009/0229823 A1 Sep. 17, 2009

Related U.S. Application Data

(60) Provisional application No. 61/036,325, filed on Mar. 13, 2008.

(51) Int. Cl.
*E21B 43/08* (2006.01)

(52) U.S. Cl. ..... 166/231; 166/227

(58) Field of Classification Search ..... 166/227–230, 166/231, 233

See application file for complete search history.

(56) References Cited

U.S. PATENT DOCUMENTS

| | | | | | |
|---|---|---|---|---|---|
| 1,229,437 | A | * | 6/1917 | Foster | 210/458 |
| 1,569,098 | A | * | 1/1926 | Mark | 175/19 |
| 1,821,659 | A | * | 9/1931 | McEvoy, Jr. | 166/234 |
| 1,950,202 | A | * | 3/1934 | Willers | 166/231 |
| 2,303,134 | A | * | 11/1942 | O'Donnell | 166/228 |
| 2,335,558 | A | * | 11/1943 | Young | 166/228 |
| 2,600,150 | A | * | 6/1952 | Abendroth | 166/228 |
| 2,835,328 | A | * | 5/1958 | Thompson | 175/314 |
| 2,837,032 | A | * | 6/1958 | Horsting, Sr. | 92/78 |
| 3,216,505 | A | * | 11/1965 | Johansson | 166/230 |

(Continued)

FOREIGN PATENT DOCUMENTS

EP 0309 186 * 9/1988

OTHER PUBLICATIONS

International Search Report and Written Opinion dated Dec. 23, 2011 for corresponding PCT Application No. PCT/US2011/043966 filed Jul. 14, 2011.

*Primary Examiner* — Kenneth L Thompson

(74) *Attorney, Agent, or Firm* — David G. Matthews; Fred Pruner; Rodney Warfford

(57) ABSTRACT

Disclosed herein is an assembly for use in a wellbore which includes a base pipe; a filter medium surrounding at least a portion of the external surface of the base pipe; and an internally profiled sleeve surrounding at least a portion of the filter media. Also included is a method for attaching a hardware accessory to a sand screen assembly which includes providing a base pipe having an inner surface and an outer surface; surrounding the outer surface of the base pipe with a filter medium; engaging the sleeve with the filter medium; and connecting the hardware accessory to the sleeve. Also included is a downhole apparatus which includes a basepipe, where at least a portion of the external surface of the basepipe is profiled; and a sleeve mounted external to the basepipe, where the internal profile of the sleeve corresponds to the external profile of the basepipe.

9 Claims, 10 Drawing Sheets

U.S. PATENT DOCUMENTS 4,105,262 A 8/1978 Richey
4,365,669 A * 12/1982 Wagner et al. ..... 166/231
4,428,423 A * 1/1984 Koehler et al. ..... 166/231
4,438,822 A 3/1984 Russell
4,600,063 A 7/1986 Beasley
4,630,690 A 12/1986 Beasley et al.
4,693,835 A * 9/1987 Arai ..... 210/777
5,034,129 A * 7/1991 Ten Hove ..... 210/490
5,339,895 A * 8/1994 Arterbury et al. ..... 166/227
5,515,915 A * 5/1996 Jones et al. ..... 166/51
5,823,260 A * 10/1998 McConnell et al. ..... 166/230
5,860,760 A 1/1999 Kirk
5,979,551 A * 11/1999 Uban et al. ..... 166/233
6,006,830 A 12/1999 Barron et al.
6,125,932 A * 10/2000 Hamid et al. ..... 166/233
6,158,507 A * 12/2000 Rouse et al. ..... 166/228
6,745,843 B2 * 6/2004 Johnson et al. ..... 166/386
6,886,634 B2 * 5/2005 Richards ..... 166/278
7,578,043 B2 * 8/2009 Simpson et al. ..... 29/522.1
2004/0140089 A1 * 7/2004 Gunneroed ..... 166/228
2005/0028977 A1 * 2/2005 Ward ..... 166/278
2005/0200127 A1 * 9/2005 Johnson et al. ..... 285/333
2008/0035330 A1 * 2/2008 Richards ..... 166/228
2008/0142227 A1 * 6/2008 Yeh et al. ..... 166/369

* cited by examiner

METHODS AND APPARATUS FOR ATTACHING ACCESSORIES TO SAND SCREEN ASSEMBLIES

RELATED APPLICATIONS

This patent application claims priority to U.S. provisional patent application Ser. No. 61/036,325 filed on Mar. 13, 2008, incorporated herein by reference.

BACKGROUND

Various subterranean formations contain hydrocarbons in fluid form which can be produced to a surface location for collection. Generally, a wellbore is drilled, and a production completion is moved downhole to facilitate production of desired fluids from the surrounding formation. Many of the formation fluids, however, contain particulates, e.g., sand, that can wear or otherwise detrimentally impact both downhole and surface components.

Gravel packing techniques, including frac packing procedures, are often used to control sand. In typical gravel packing operations, a slurry of gravel carried in a transport fluid is pumped into a well annulus between a sand screen and the surrounding casing or open wellbore. The deposited gravel is dehydrated (i.e., the transport fluid is removed), and the remaining gravel facilitates blocking of sand or other particulates that would otherwise flow with formation fluids into the production equipment.

In some gravel packing operations, difficulty arises in obtaining uniform distribution of gravel throughout the desired gravel pack region. For example, a poor distribution of gravel can result from premature loss of transport fluid, which causes the creation of bridges that can prevent or reduce further distribution of gravel past the bridge. Also, certain manmade isolation devices, such as packers, can present barriers to distribution of the gravel slurry. Shunt tubes have been used to bypass bridges and/or manmade isolation devices to ensure complete gravel packing (see, e.g., U.S. Pat. No. 7,407,007).

Traditionally, the method to attach hardware, such as the aforementioned shunt tubes, to oilfield sand screen tubulars (and other downhole equipment) involved welding. Unfortunately, welding often introduces stress into the tubulars that can cause defects (for example corrosion, corrosion cracking, and surface cracks) that can result in undesirable consequences, including, but not limited to failure of the tubular. Various post-welding procedures are available to minimize undesirable consequences (e.g., post-weld heat treatment to homogenize the metals or examination using dye penetrant to identify surface defects). However, these treatments can be expensive and time consuming and cause administrative hassles and only mitigate the risk of defects caused by welding rather than eliminate the risks.

Thus, for at least these reasons, it may be desirable to eliminate or reduce the welding necessary to attach hardware to tubulars or downhole equipment.

SUMMARY

Disclosed herein are methods to attach hardware to tubulars (such as sand screen basepipe) and other downhole equipment, including:

An assembly for use in a wellbore, comprising a base pipe; a filter medium surrounding at least a portion of the external surface of the base pipe; and an internally profiled sleeve surrounding at least a portion of the filter media.

Also included is a method for attaching a hardware accessory to a sand screen assembly, comprising providing a base pipe having an inner surface and an outer surface; surrounding the outer surface of the base pipe with a filter medium; engaging the sleeve with the filter medium; and connecting the hardware accessory to the sleeve.

Also included is a downhole apparatus comprising a basepipe, wherein at least a portion of the external surface of the basepipe comprises a profile; and a sleeve mounted external to the basepipe, wherein the internal profile of the sleeve corresponds to the external profile of the basepipe.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element." As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention.

Figure 1:
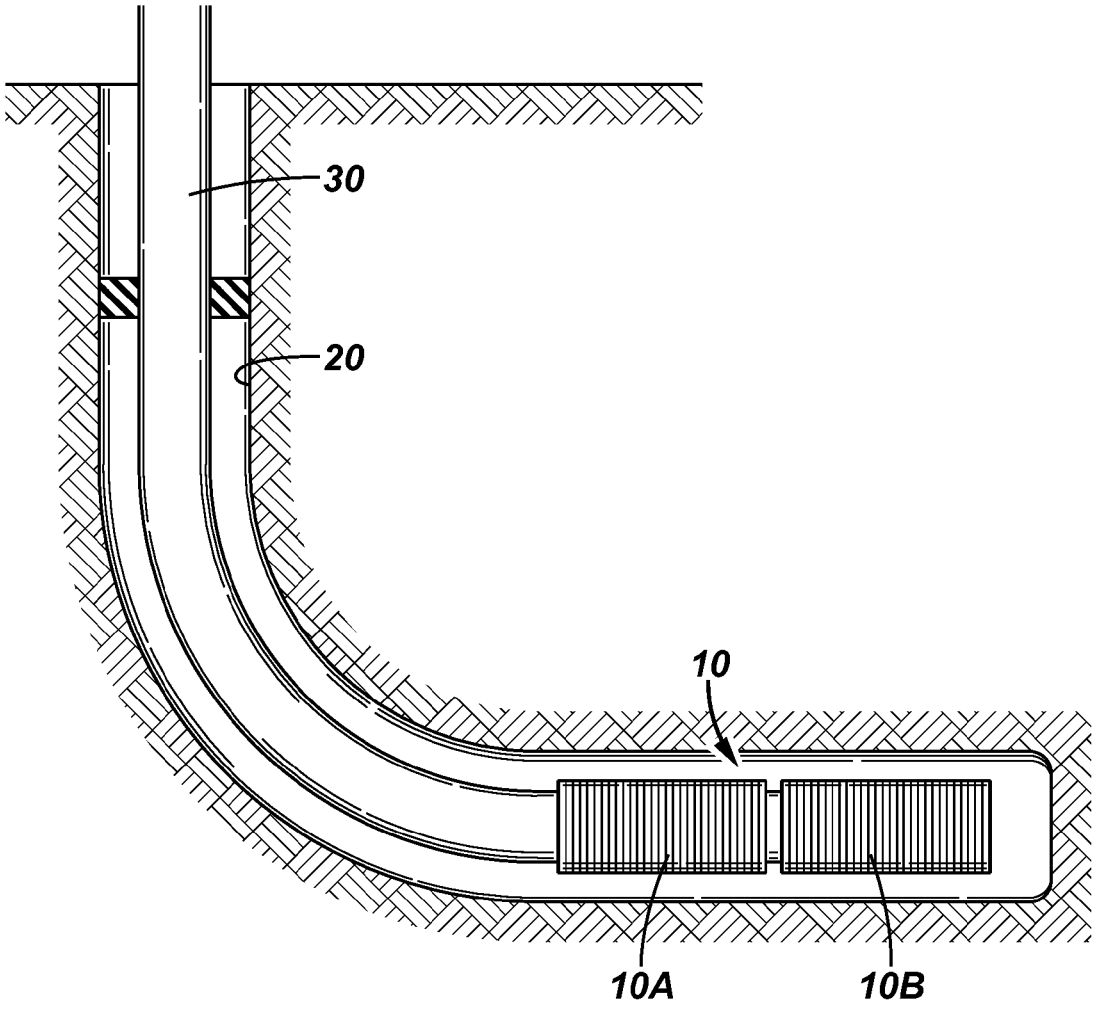
FIG. 1 is a schematic drawing of a sandscreen deployed in a wellbore.
Figure 1A:
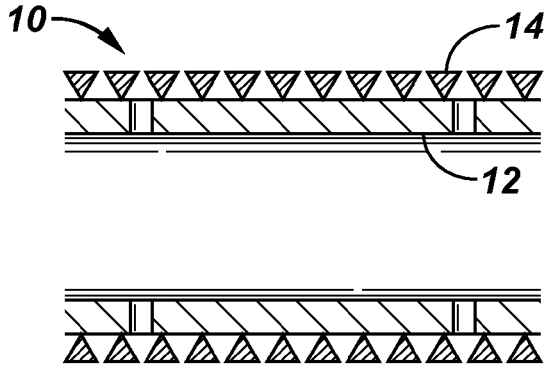
FIG. 1A is a more detailed schematic drawing of a sandscreen adjacent to a basepipe.

With reference to FIG. 1, a sand screen assembly 10 is deployed in a wellbore 20 via a conveyance string 30 (e.g., coiled tubing). The sand screen assembly generally is comprised of one or more screen sections 10A, 10B, each of which comprise a base pipe 12 and a filter media 14 as is shown in FIG. 1A. The base pipe 12 may be a perforated base pipe or include inflow control devices (nozzles inserts or nozzle rings with chambers). The filter media 14 may include wire-wrapped screen, mesh screen, or any other type of filter media which is known in the art.

In some instances, it is desirable to attach external hardware to a sand screen assembly. One non exclusive example of hardware that may be desirable to attach external to a sand screen assembly is a shunt tube which provides an alternative flow path for fluids being transported downhole, e.g., gravel pack slurry. The conventional method for attaching hardware to a sand screen assembly involves welding to the tubular base pipe. Welding, however, introduces stresses into the base pipe forming the sand screen assembly that can cause stress corrosion cracking, surface cracks, and other defects that can result in failure of the base pipe. Typical weld procedures involve a post-weld heat treatment to homogenize the pipe material to remove induced stresses. Another post-welding process for tubulars typically performed is a non-destructive weld examination using dye penetrant which identifies surface defects that can result in cracking of the tubulars. These post-welding processes often involve an in depth system of quality control documents, traceability, and personnel training.

Base pipe tubulars used for screen applications are normally not designed to be welded. Depending on the metallurgy and mechanical properties of the tubular, the above-mentioned heat treatment process may, in some instances, regain the tubular's integrity. With increased yield of the tubular and more sophisticated metallurgy, regaining integrity after welding may, however, not be possible. Accordingly, in many applications, welding of the tubulars may permanently reduce its integrity. Eliminating welding to the base pipe tubular reduces the measures necessary to assure the base pipe integrity has not been compromised and the amount of quality assurance personnel time and documentation.

Figure 2:
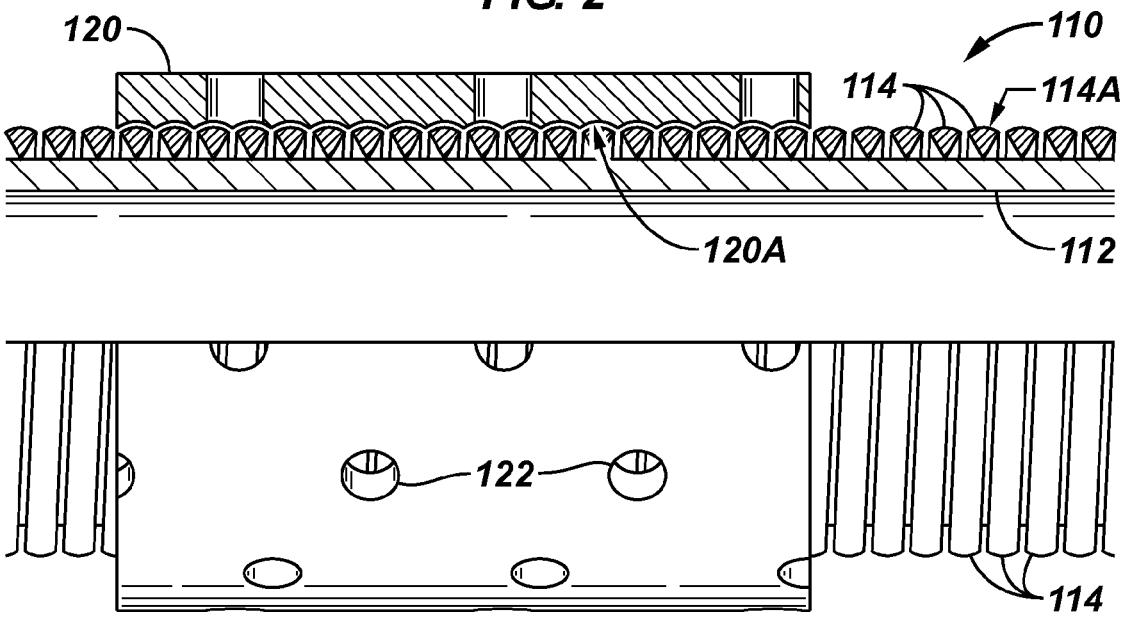
FIG. 2 is a schematic drawing of a sandscreen and sleeve in accordance with embodiments as disclosed herein.
Figure 4:
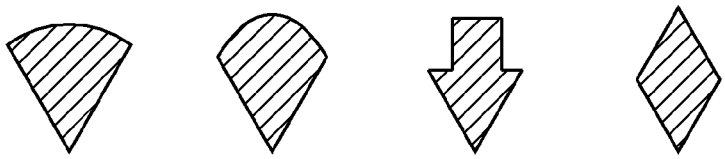
FIG. 4 is a schematic drawing of non-exclusive examples of wire wrap profiles which may be used in embodiments as disclosed herein.

In one embodiment, as shown in FIG. 2, a sand screen assembly 110 is provided having a base pipe 112 surrounded by wire-wrapped screen 114. In this embodiment, the wire-wrap screen 114 has a dome-shape profile 114A positioned on the outside of the wire-wrap screen 114 (direct-wrap or slip-on wrap). A sleeve 120 having ports 122 is machined (or otherwise formed with a particular profile) on its inner diameter such that the inner profile 120A of the sleeve mates the dome-shaped outer profile 114A of the screen 114, and can be threadably connected thereon, essentially creating a nut-and-bolt joint where the sleeve is the nut and the wire-wrap screen is the bolt. Alternatively, the wrap wire could be flat on the outside and the slot opening of the wrap wire could be sufficiently wide such that a sleeve could have an inner diameter profile that engages the slot opening of the wrapped wire. These nut-and-bolt configurations allow for the transfer of axial load through the direct wrap screen into the base pipe. Indeed, other embodiments may include any shaped wrap wire whether round or shaped with multiple sides where the sides can be flat, rounded or scuffed (such as sand/bead blasted) such that the inner profile of the sleeve can be mated thereto in threaded engagement. This sleeve 120 thereby provides a surface external the base pipe 112 and isolated from the base pipe via the wire wrap filter 114 on which accessories or external hardware can be connected even by welding without reducing the integrity of the base pipe tubular, such that, for example, shunt tubes 152 (see FIG. 2B) may be attached via hardware 150 to the sleeve 120. Still further, in alternative embodiments, the wrap wire screen 114 can be designed with a protruding profile such that it provides a contact area for the "threaded sleeve" thus providing a greater loading capacity. After the wire is wrapped as a screen filter the resulting protruding feature will provide a significant thread contact area. The protruding profile of the wrap wire can have any shape or height (see FIG. 4 for non-exclusive examples of protruding profiles which it may be desirable to have on the wire wrap).

Figure 2A:
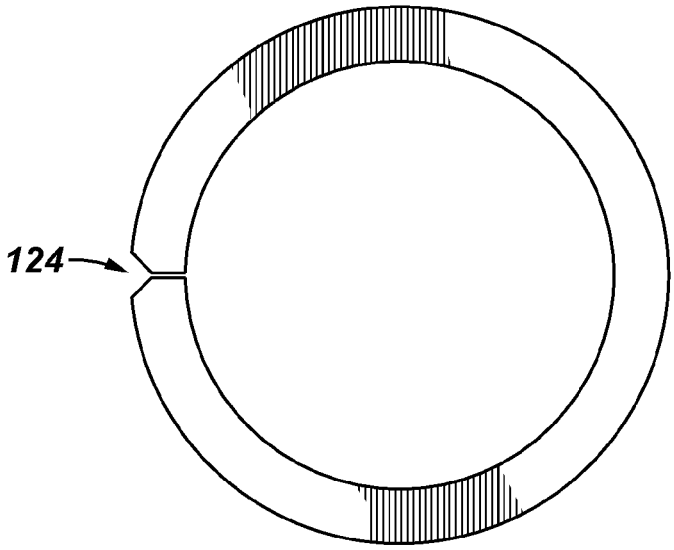
FIG. 2A is a cross sectional view of an embodiment of a sleeve such as is shown in FIG. 2.
Figure 2B:
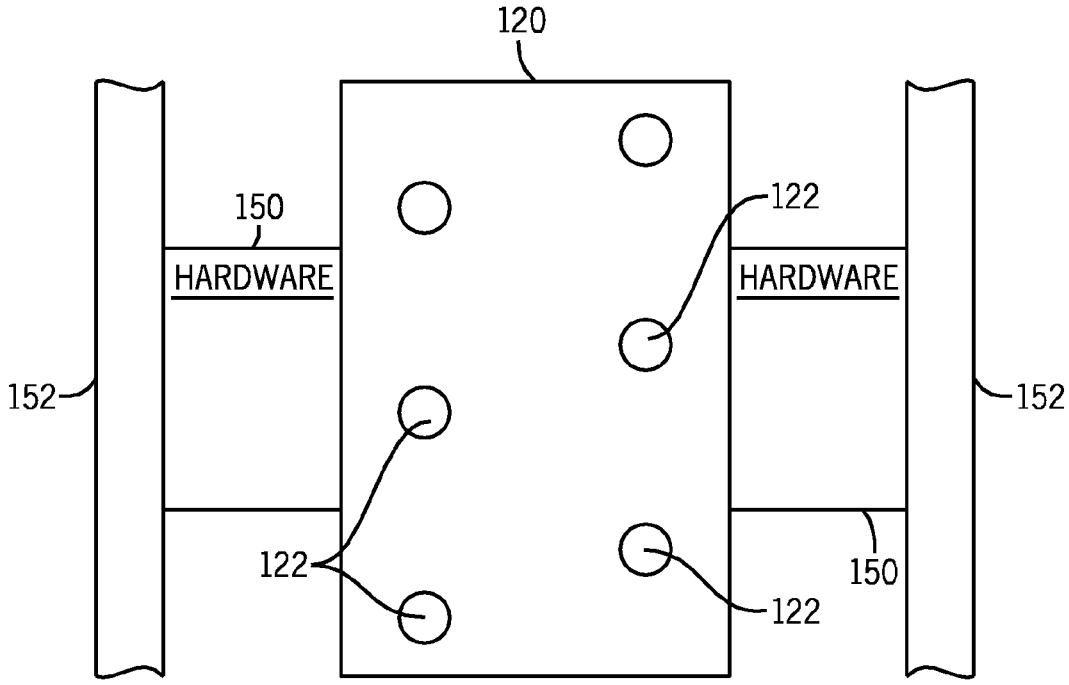
FIG. 2B is an illustration depicting attachment of shunt tubes to the sleeve in accordance with an embodiment of the invention.

In other embodiments, still with respect to FIG. 2, additional features can be added to the sleeve 120 to increase its axial and torsional loading capacity. For example, the sleeve 120 can be designed to provide an interference fit by machining its inner diameter "female thread" profile to match or have an interference with the wire wrap jacket "male thread" profile provided by the wrap wire. As is shown in FIG. 2A, the sleeve could include a longitudinal split 124, which, when the sleeve is positioned on the wire wrap jacket 114 and the sleeve is clamped in place, could be welded along the split or bolted together or using a similar method to attach the two sides. The shrinking of the weld during cooling creates a squeeze of the sleeve onto the wire wrap jacket outer diameter. Or, alternatively, the sleeve 120 could be heated to expand the sleeve thus allowing it to be positioned on the wire wrap screen and then subsequent cooling of the sleeve would allow the sleeve to shrink-fit onto the wire wrap screen 114.

The sleeve 120 can also be designed to have holes 122 in it within which plug welds can be placed thus welding the sleeve to the outer diameter surface of the wire wrap jacket 114. The number of holes and plug welds can be adjusted to meet the torsional and axial loading capacity requirements as would be determined by one of ordinary skill in the art.

In other embodiments, the sleeve 120 could be coated on the inner diameter with an adhesive (e.g., JBWeld available from JB-Weld Company of Sulphur Springs, Tex. (www.jbweld.net or Loctite available from Henkel Int'l (www.loctite.com) or other adhesive as would be known to one of ordinary skill in the art), which, when put in place, bonds with the wire wrap jacket outer diameter providing substantially complete contact area for resisting torsion and axial loading.

Figure 3:
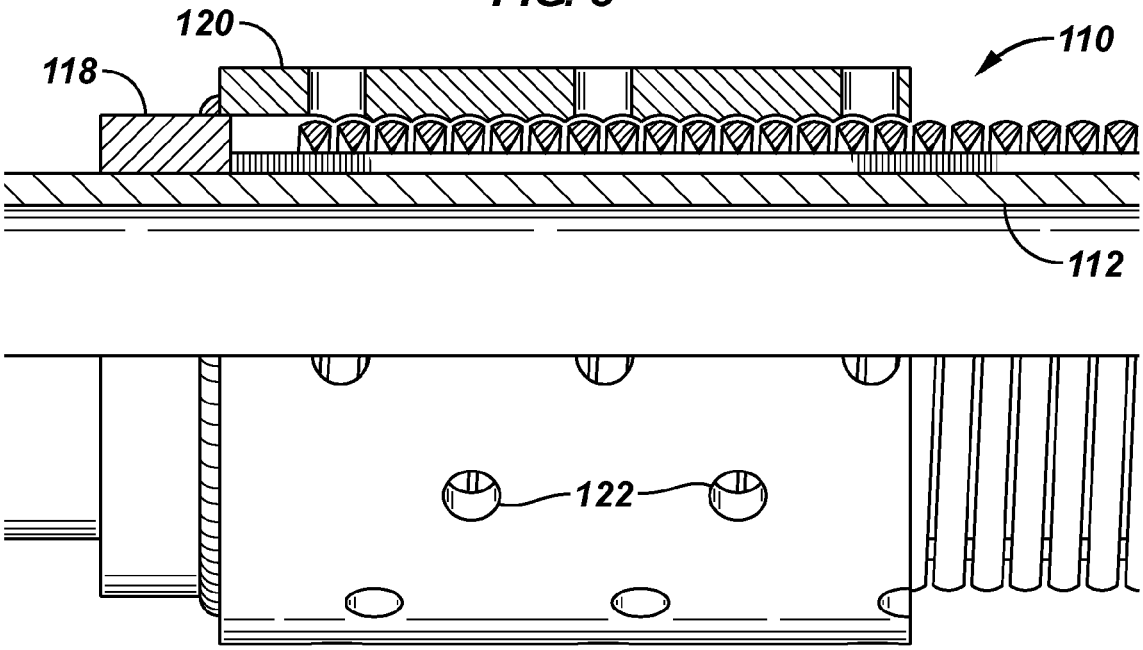
FIG. 3 is a schematic drawing of a sandscreen and sleeve in accordance with embodiments as disclosed herein.

The sleeve can be designed to implement all features above simultaneously or select ones. Moreover, the various sleeve embodiments can be applied either anywhere along the wire wrap screen (as shown in FIG. 2 and discussed above) or at the termination of the wire wrapped screen (as shown in FIG. 3). The embodiment shown in FIG. 3 includes the same features as described above for FIG. 2, except that the sleeve 120 may also be connected (e.g., by weld or other) to the end ring (load ring or termination ring) 118, where the end ring provides a weld surface isolated from the base pipe.

Figure 5:
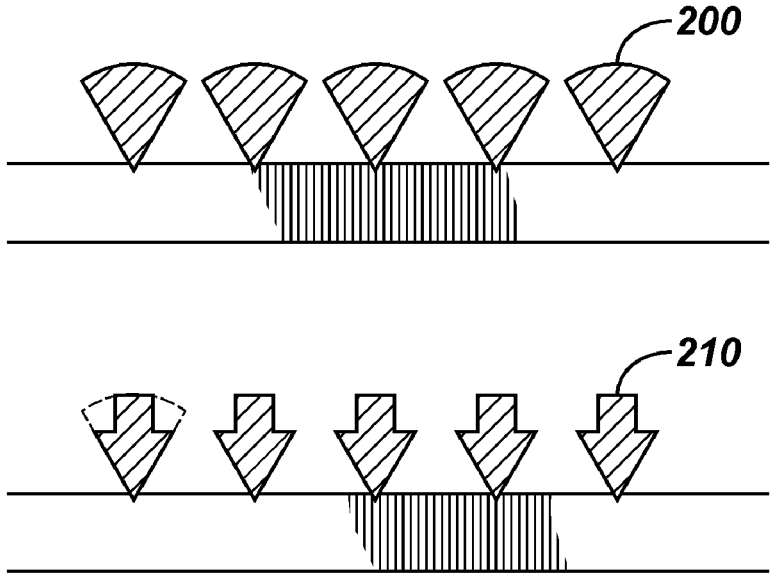
FIG. 5 is a schematic drawing of non-exclusive examples of wire wrap profiles which may be used in embodiments as disclosed herein.

In yet another embodiment the wrap wire of an already-wrapped wire wrap screen 200 can be machined to have a protruding profile 210 that provides a contact area for the "threaded sleeve." This embodiment is similar to that described above except that the profile is machined after wrapping as opposed to the wrap wire having the desired profile before wrapping. FIG. 5 depicts a protruding profile 210 created by machining/grinding the wrap wire of an already-wrapped screen. Some of the material on the edge of the wrapping wire is removed to make the slot opening bigger and thus making it possible for the "threads" on the ID of the sleeve to engage into the bigger slots created between the wrapping.

Figure 6:
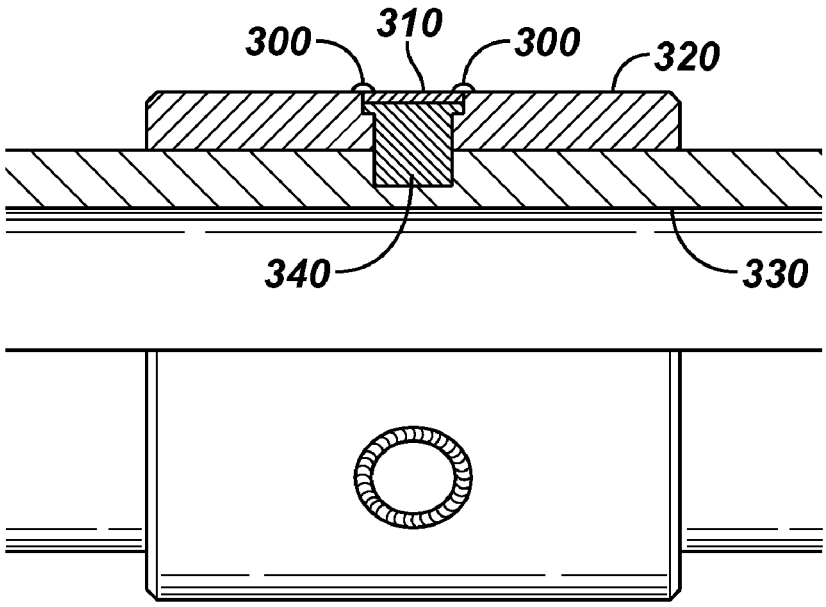
FIG. 6 is a schematic drawing of a sandscreen and sleeve in accordance with embodiments as disclosed herein.

With reference to FIG. 6, in a further embodiment, a sleeve 320 can be mechanically joined to a base pipe 330 by pinning. A sleeve 320 and base pipe 330 can be drilled with matching holes in which pins 340 are inserted to provide a joint that can withstand axial and torsion loads. To prevent the pins from backing out they may be of a weldable material or alternatively, they may be covered by a weldable retaining pin 310 which is then welded on by welds 300. The number of holes/pins is determined by one of ordinary skill in the art without undue experimentation with consideration of the strength of the pin, sleeve, and base pipe materials and the size of the holes and pins.

Figure 7:
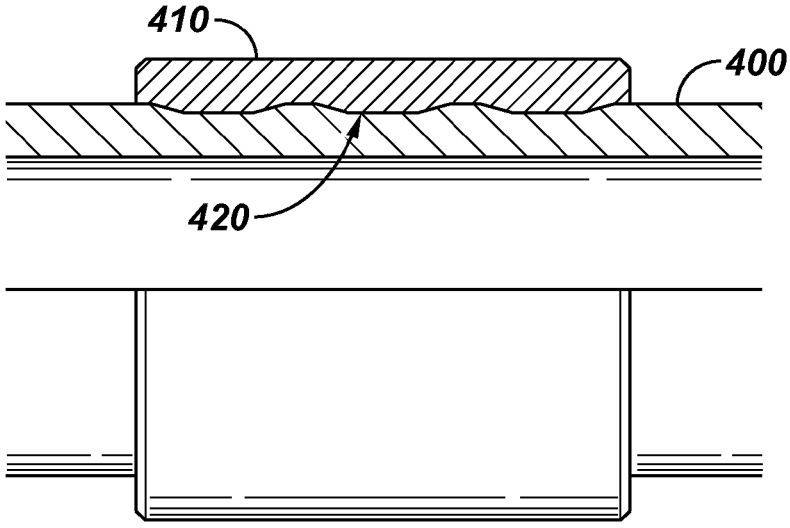
FIG. 7 is a schematic drawing of a basepipe and sleeve in accordance with embodiments as disclosed herein.

With reference to FIG. 7, a sleeve 410 can be mechanically joined to a base pipe 400 by cutting, forming, or grinding a recess 420 in the base pipe outer diameter and sleeve inner diameter and installing a heat-expanded sleeve 410 over the recess 420 and allowing the sleeve to cool and shrink into the recess. This joint requires the inner diameter of the sleeve 410 to be equal to or less than the recess 420 outer diameter machined into the base pipe 400. The recess profile in the base pipe 400 can have multiple recesses providing greater axial loading resistance. Alternatively, the sleeve can be split axially (not shown) and the split welded once positioned creating a shrink fit upon cooling of the weld similar to 124 in FIG. 2A.

Figure 8:
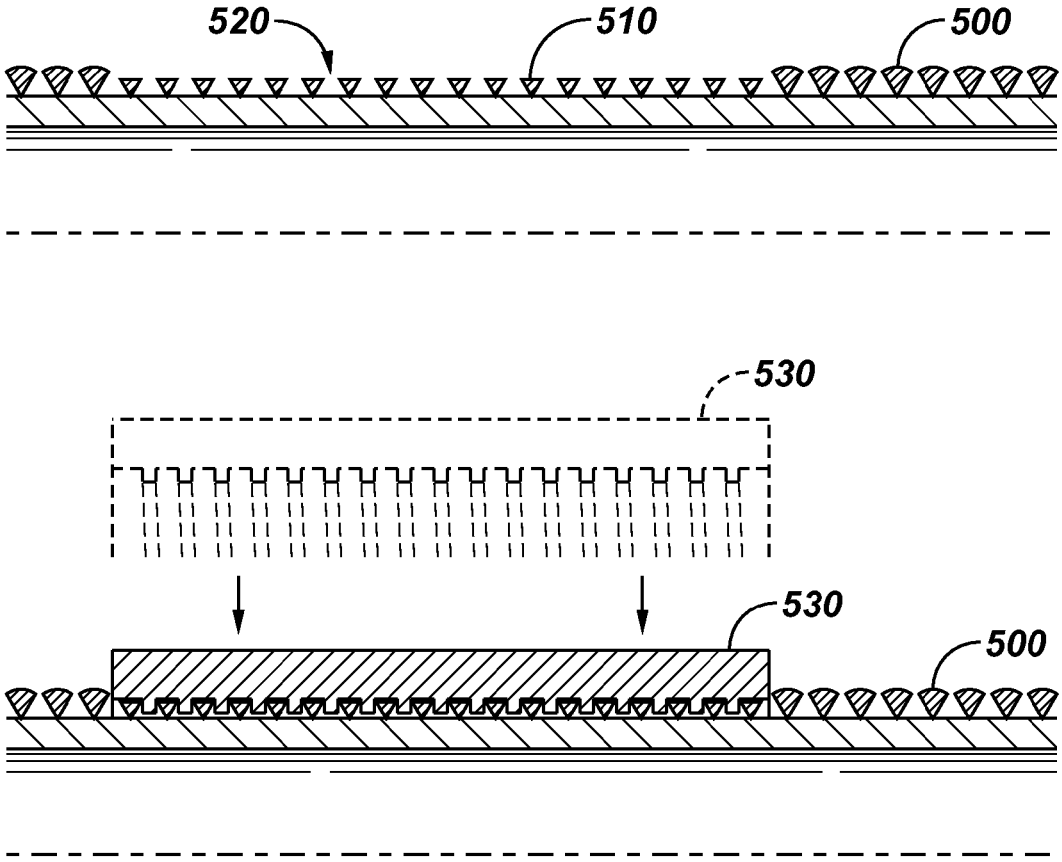
FIG. 8 is a schematic drawing of a sandscreen and sleeve in accordance with embodiments as disclosed herein.

With reference to FIG. 8, due to the tapered top of the wrap wire 500, the screen outer diameter can be machined down 510 to expose more space/width 520 between wrap wires. A sleeve can be machined with an inner diameter thread profile that matches opening width of the machined wrap wire.

Figure 9A:
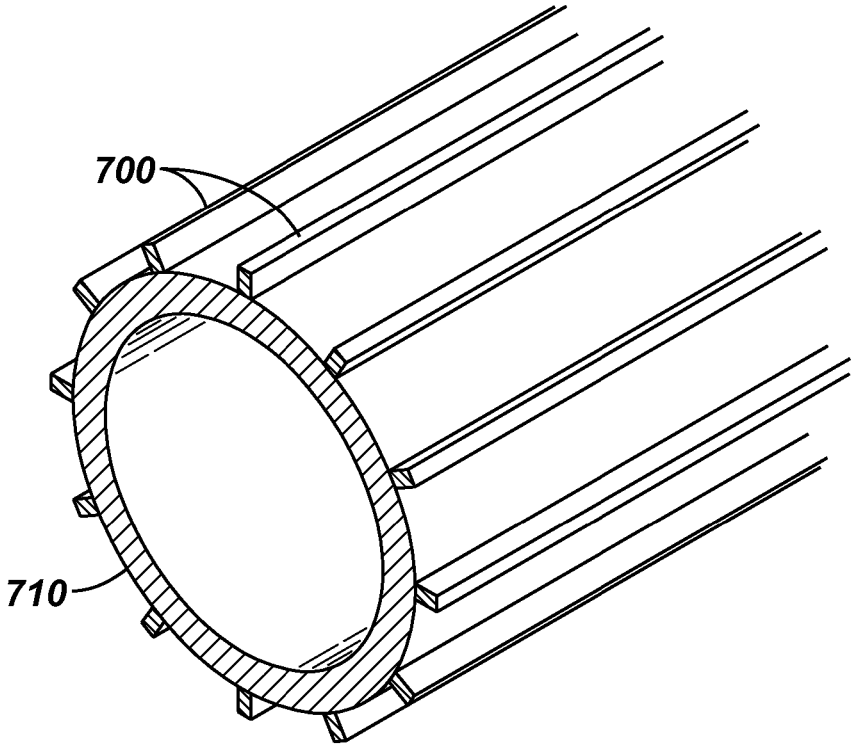
FIG. 9A is a schematic drawing of a basepipe having longitudinal ribs.
Figure 9B:
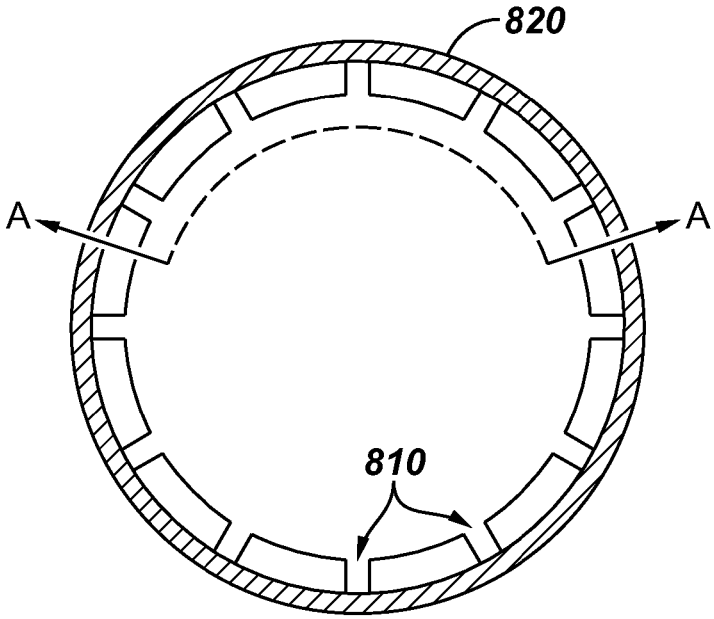
FIGS. 9B and 9D are schematic drawings of a sleeve in accordance with embodiments as disclosed herein.
Figure 9C:
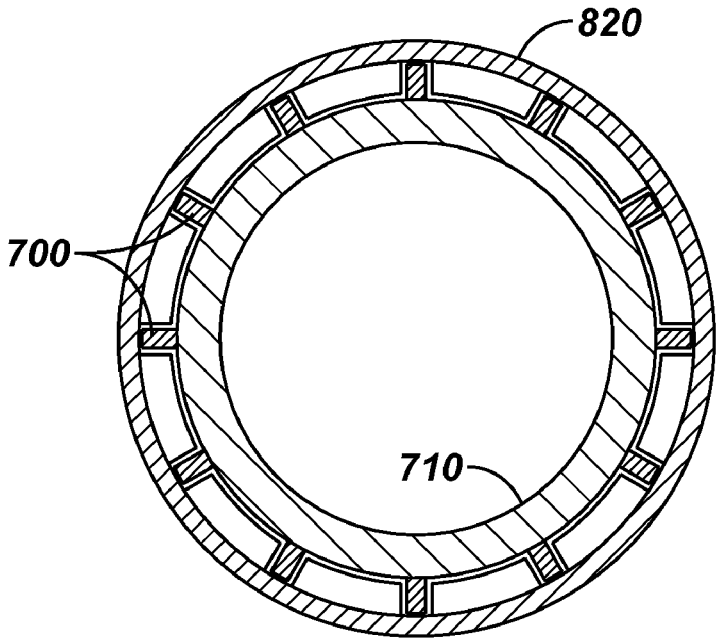
FIG. 9C is a schematic drawing of a sleeve installed on a device having longitudinal ribs as disclosed herein.
Figure 9D:
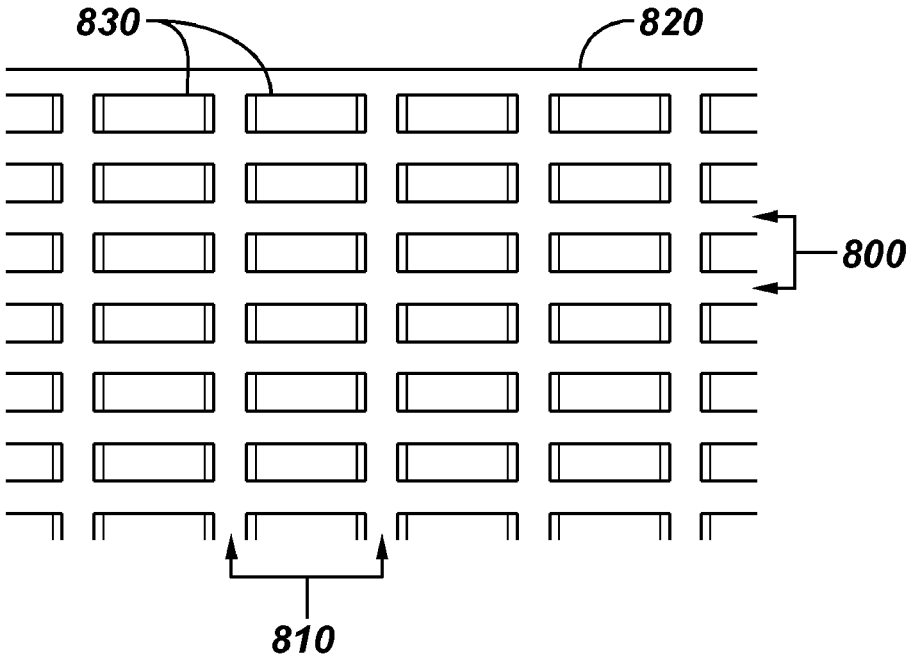

With reference to FIGS. 9A, 9B, 9C, and 9D, as is well known in the art, it is often desirable to run axial ribs 700 along the basepipe 710 below the filter layer (e.g., the wire wrap) (not shown for clarity). When installed on the base pipe, 710, the sleeve 820 can have threads that extend through the filter medium and into the axial wire profile where the sleeve's threads are "cut out" 810 to allow the axial wires 700 to pass through the sleeve threads. This allows the sleeve 820 to engage the axial wires 700 thus allowing the transfer of torque through the axial wires. A schematic view of the inside of the sleeve 820, unfolded, is shown in FIG. 9D in which the internal "threads" 830 on the sleeve not only have spaces 800 for the wire wrap, but also have spaces 810 to fit within the axial ribs 700 to provide the transfer of torque through the axial wires.

Figure 10A:
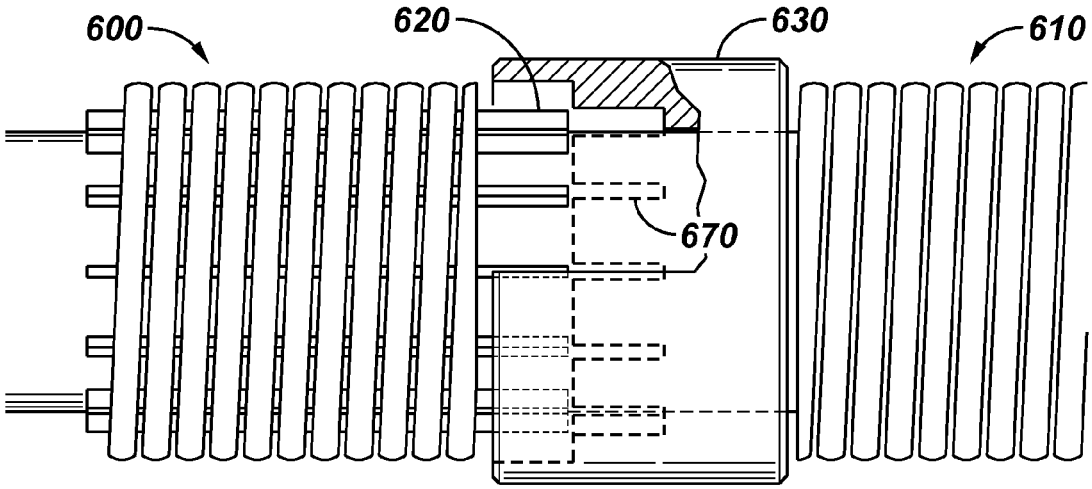
FIGS. 10A, 10B, and 10C are schematic drawings of a sandscreen and sleeve in accordance with embodiments as disclosed herein.
Figure 10B:
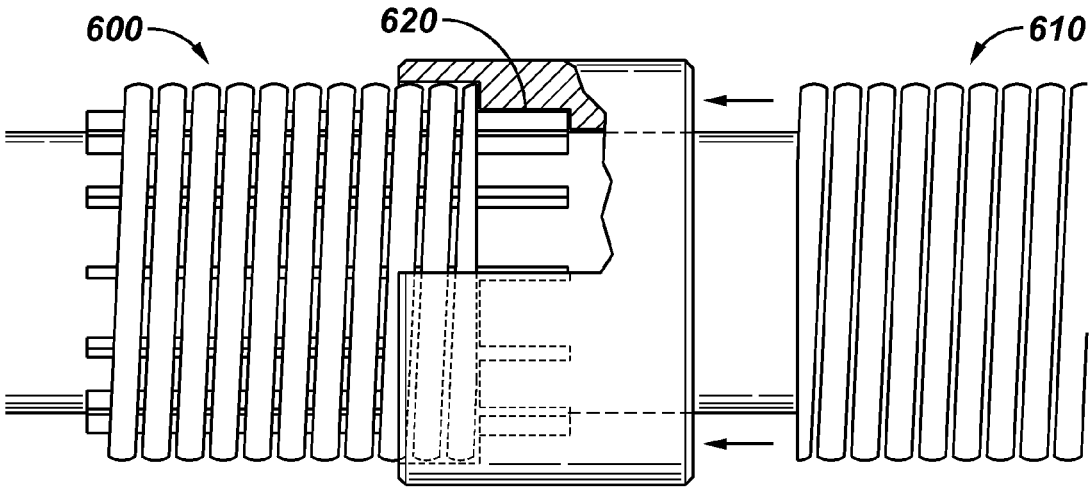
Figure 10C:
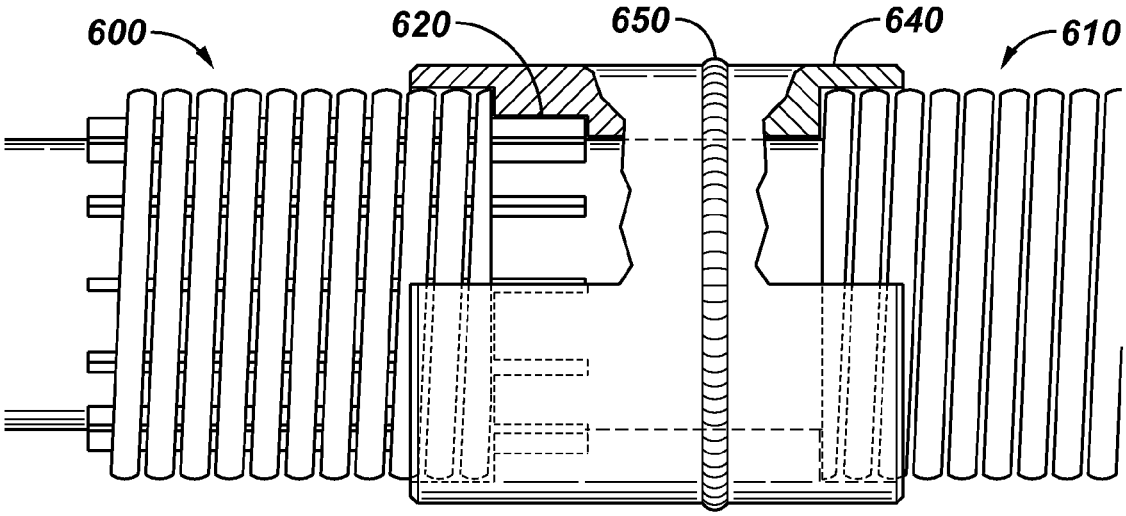

With reference to FIGS. 10A, 10B, and 10C, a direct wrap wire wrap jacket has a gap between two wrapped sections 600 and 610 where one of the sections have axial wires running below the wire wrap jacket exposed 620 and the other section has the axial wires cut flush with the wrap wire (not shown, hidden below wire wrap 610). A split ring 630 having a profile 670 on its inner diameter for mating with the axial wires is installed in the region of no axial wires. With both halves on base pipe the two halves are slid to engage with the axial wires 620. A second split ring 640 with a stepped inner diameter profile is placed between the previously installed split ring 630 and the wrapped section without axial wires exposed 610. The second ring traps the two rings in place. The two rings are welded together at weld 650. Both rings have an extension that resides over the wrap wire of the jacket which provides sand control for the jacket termination. The axial wires provide torque resistance and the jacket sections provide axial load resistance.

In all embodiments of the present invention, the terms "sleeve" and "ring" may be used interchangeably. Moreover, it is the intention of the present invention that each embodiment described herein provides a surface external the base pipe on which accessories/hardware may be connected to the sand screen assembly, as by welding, bolting, or any other acceptable method as would be determined by one of ordinary skill in the art without undue experimentation.

While the invention has been disclosed with respect to a limited number of embodiments, those skilled in the art will appreciate numerous modifications and variations therefrom. It is intended that the appended claims cover such modifications and variations as fall within the true spirit and scope of the invention.

The invention claimed is:

1. A method comprising:

providing a base pipe;

wrapping the base pipe with a screen, the screen comprising an outer profile; and mating the screen with a sleeve, comprising engaging the outer profile of the screen with an inner profile of the sleeve such that a load placed on the sleeve is transferred through the screen to the base pipe, wherein the mating comprises sliding the sleeve over the screen while allowing the sleeve to expand at a longitudinal slit of the sleeve and welding the longitudinal slit shut after the inner profile of the sleeve is engaged with the outer profile of the screen.

2. An assembly for use in a wellbore, comprising:

a base pipe;

a spirally-wrapped screen adapted to circumscribe the base pipe and having an outer profile;

a longitudinally extending member; and a longitudinally-split sleeve adapted to substantially circumscribe the screen and comprising an outer surface connected to the member, the sleeve having a spirally extending inner profile adapted to engage the outer profile of the screen to transfer a load exerted on the sleeve by the member through the screen and to the base pipe.

3. The assembly of claim 2, wherein the member comprises a shunt tube.

4. An assembly for use in a wellbore, comprising:

a base pipe;

a screen mounted to the base pipe, the screen adapted to circumscribe the base pipe and having an outer profile; and a sleeve adapted to substantially circumscribe the screen, the sleeve comprising:

a first longitudinal section comprising a first inner profile adapted to engage the outer profile of the screen to transfer a load exerted on the sleeve through the screen and to the base pipe; and a second longitudinal section longitudinally extending beyond the screen to mount the screen to the base pipe, wherein the sleeve comprises a radial opening in the second longitudinal section, the assembly further comprising a pin adapted to be inserted into the radial opening to secure the sleeve to the base pipe.

5. An assembly for use in a wellbore, comprising:

a base pipe;

a first screen adapted to circumscribe the base pipe and having a first end having a first end profile;

a second screen adapted to circumscribe the base pipe and having a second end having a second end profile, wherein a longitudinally extending gap exists between the first end of the first screen and the second end of the second screen;

a first sleeve to substantially circumscribe the base pipe and comprising a first inner profile adapted to engage the first end profile, wherein the first end profile comprises exposed members that extend substantially parallel to a longitudinal axis of the base pipe and are adapted to engage the first inner profile; and a second sleeve to substantially circumscribe the base pipe and abut the first sleeve, the second sleeve comprising an inner profile adapted to engage the second end profile.

6. The assembly of claim 5, wherein the first sleeve comprises a split ring.

7. The assembly of claim 5, wherein the second sleeve comprises a split ring.

8. A method comprising:

providing a base pipe;

wrapping the base pipe with a screen, the screen comprising an outer profile; and mating the screen with a sleeve, comprising engaging the outer profile of the screen with an inner profile of the sleeve such that a load placed on the sleeve is transferred through the screen to the base pipe, wherein the mating comprises radially expanding the sleeve, sliding the sleeve onto the screen and subsequently radially contracting the sleeve.

9. The method of claim 8, wherein the expanding comprises heating the sleeve and the contracting comprises cooling the sleeve.

* * * * *